United States Patent [19]

Olberg et al.

[11] 4,268,720

[45] May 19, 1981

[54] SCRAMBLER SPEECH TRANSMISSION AND SYNCHRONIZATION SYSTEM

[75] Inventors: Stirling M. Olberg, Waltham; Vernon J. Fowler, Billerica; Bruce Anderson, Tewksbury, all of Mass.

[73] Assignee: GTE Laboratories Incorporated, Waltham, Mass.

[21] Appl. No.: 42,661

[22] Filed: May 25, 1979

[51] Int. Cl.[3] ..... H04K 1/00

[52] U.S. Cl. ..... 179/1.5 R; 455/26

[58] Field of Search ..... 179/1.5 R, 1.5 S; 178/22; 375/2; 455/26

[56] References Cited

U.S. PATENT DOCUMENTS

| | | | |
|---|---|---|---|
| 3,696,207 | 10/1972 | Lundin et al. | 455/30 |
| 3,723,878 | 3/1973 | Miller | 179/1.5 R |
| 3,909,534 | 9/1975 | Majeau et al. | 179/1.5 R |
| 4,100,374 | 7/1978 | Jayant et al. | 179/1.5 R |
| 4,133,977 | 1/1979 | McGuire et al. | 179/1.5 R |
| 4,171,513 | 10/1979 | Otey et al. | 375/2 |
| 4,188,580 | 2/1980 | Nicolai et al. | 179/1.5 R |

*Primary Examiner*—Howard A. Birmiel
*Attorney, Agent, or Firm*—Fred Fisher

[57] ABSTRACT

A system is provided for time segment scrambling speech encoding, wherein an internal key code is provided for control thereof. The scrambling and reset units are synchronized by start and reset clock pulses. The scrambling unit can also scramble individual segments by an inversion process in accordance with a second internal key code, such as, for example, time inversion and frequency inversion. A related system for unscrambling scrambled speech transmission and synchronization therefore is set forth as another embodiment of the invention.

11 Claims, 2 Drawing Figures

SCRAMBLER SPEECH TRANSMISSION AND SYNCHRONIZATION SYSTEM

BACKGROUND OF THE INVENTION

1. Field of the Invention

This invention relates to scrambler speech transmission systems, and, in particular, to means for scrambler speech synchronization over narrow-band (e.g., telephone or radiotelephone) channels to make the transmission secure against accidental or intentional eaves dropping. Accordingly, it is a general object of this invention to provide new and improved systems of such character.

It is a further object of the invention to accomplish scrambler speech transmission and synchronization with the aid of one or more "keys" (i.e., physical keys, key numbers, key words, or key groups of alphanumeric or other characters or symbols) prearranged between or among the communicating parties, which keys can be quickly and easily changed.

2. Description of the Prior Art

There are a wide variety of old systems for speech scrambling. For purposes of comparison with the instant invention, three old systems are discussed.

The first two systems yield scrambled speech with the same bandwidth as the original speech, but they do not utilize a key. The first system, familiar to those who have played a phonograph record backwards, is time inversion scrambling. The speech is first recorded, then the recording is played in reverse time sequence. The second system is the frequency counter-part of the first system, namely frequency inversion scrambling. In this system, the frequency spectrum of the original speech is inverted, e.g., by the process of single sideband modulation onto the lower sideband of a carrier.

The third old system is a generic form of key encoded scrambling called time sequence scrambling. In this system, short intervals of the original speech are selected for transmission in a permuted order. The order in which the segments are selected is determined by the prearranged key. Time sequence scrambling can be accomplished with either the original analog speech signal or with a digitally-encoded version of the signal (in which case digital pulses are scrambled).

All of the above systems for scrambling suggest the corresponding systems for unscrambling. For time inversion scrambling, the process is repeated, thereby restoring the signal to its original time sequence. For frequency inversion scrambling, repetition of the process restores the spectrum to its original condition. For time sequence scrambling, the segments are selected from the incoming signal by means of an "unscrambling key." This key is the permutation of consecutive integers which, when used to select the integers of the "scrambling key", yields a set of consecutive integers.

Non-key-encoded scramblers, having only one mode of scrambling per device, are useful in commercial telephone service for providing a modicum of security in business communications, particularly where accidental cross-connection might occur to a third party. However, the more widely these devices are used, the less security they offer. A key-encoded scrambler is secure, even in proliferated use, because different users can use different keys.

The probability of a transmission being unscrambled by a third party can be kept very low, even if the third party has the unscrambling apparatus, provided that the number of different keys is very large.

An application for a key encoded scrambler is in a police radio. It would not do to use a non-key-encoded scrambler, because those criminals who use police radio receivers to monitor the reactions of the police would quickly acquire unscrambling apparatus, particularly if simple inversion techniques were used. With key encoding, the security is in the code (which can easily and frequently be changed), not in the apparatus. Thus, key-encoded scrambling systems can be used in a wide variety of applications: in police, military, civilian, and government communications, and in industry, in a wide variety of different confidential or secret business communications affecting finances, trade secrets, account data, personnel data, etc.

A principal problem with key encoded scrambling systems utilizing time sequence scrambling is that they cannot be used to obtain an unscrambled signal restored to the form of the original signal unless the signal is sent over a wideband channel, thus precluding the use of ordinary telephone or radiotelephone channels. When analog sequences are scrambled, the amplitude of the scrambled signal has abrupt discontinuities at the junctions of successive segments. To avoid distortion in the unscrambled signal, the discontinuities are preserved in transmission, which requires that the signal be sent on a wideband channel. When digital sequences are scrambled, the process of analog to digital conversion yields a wideband signal, which also is preserved in transmission through the use of a wideband channel.

Another principal problem with key encoded scrambling systems, to which this invention is particularly addressed, is the problem of synchronization: that is, the provision for signals to be sent and received over the same narrow-band or wide-band channel in such a manner as to control automatically the decoding at the receiver in the exact time sequence, determining just when the sequence is to start.

3. Prior Art Statement

As stated above, there are a wide variety of old systems for speech scrambling. A brief discussion of the prior art is set forth at col. 1, lines 20–45 of U.S. Pat. No. 3,225,142 to Schroeder, reproduced below:

"Analog communication systems have been devised in which electric signals corresponding to speech or other signals to be privately transmitted have been scrambled, garbled, or otherwise rendered more or less unintelligible in various ways. Their frequency components have been inverted with respect to a selected nominal frequency; they have been broken up into short segments which are then transmitted in alternation with corresponding short segments of another message; they have been recorded, inverted with respect to time (picked up backward) and transmitted so inverted; their transmission rate has been widely varied at a fairly high rate; and many other devices have been employed to make the relation between the electric signal as transmitted and the original message to be transmitted unobvious and therefore undecipherable. Such systems are characterized, in the main, by a perturbation or other masking effect which follows a definite and prescribed pattern, either recurring periodically in time or involving a definite numerical relation between the component frequencies of the plain message and those of the ciphered message. In general, this pattern is separate and distinct from the message to be transmitted and is unrelated to the peculiarities of the particular message, being controlled entirely by means external to portions of the apparatus or circuit which carry the message signals themselves."

The foregoing reference includes, in the opinion of the applicants and their attorney, the closest prior art of which they are aware. This statement shall not be construed as a representation that a search has been made or that no better art exists.

The relevance of the cited reference is in the paragraph quoted above, as a statement of prior art which exists.

SUMMARY OF THE INVENTION

In accordance with one embodiment of the invention, a system for scrambling speech transmission and synchronization in a coded manner includes a microphone for converting speech in its audio form to an electrical form. Scrambling means, coupled to the microphone, are provided for coding, as by time sequencing, individual segments of speech in accordance with an internal key code. The scrambling means can be synchronized by a reset pulse for resetting the order of coding within the scrambling means, and by a clock pulse which determines the start of each segment. A first AND gate has one input coupled to receive signals at a burst frequency provided by an oscillating means, and has a second input coupled to an enabling level where a "talk" switch is "on", the output of the gate being coupled to an input of a first frequency dividing means which converts the burst frequency to a clock frequency. The clock frequency is coupled both to a second frequency dividing means which determines the frequency of synchronization burst tones, and to one input of a second AND gate, which gate is coupled to a dividing counter. The output of the counter is coupled to the reset terminal of a flip-flop means which is set by a pulse provided by a pulse generator activated by the "talk" switch being placed in the "on" position. The set output of the flip-flop means is coupled to a second input of the second AND gate. The reset output terminal is coupled to enable signals at the clock frequency to synchronize the scrambling means when an enabling level is present. The scrambling means, various of the dividing means, and the counter, are "reset" when the "talk" switch is "off." An output from the system is provided from either the scrambling means or from a third AND gate to which the output of the first AND gate and the set output of the first flip-flop means are inputs thereto. In accordance with certain features, the output of the second dividing means is coupled to the set terminal of the first flip-flop means. The scrambling means can also scramble individual segments by an inversion process in accordance with a second internal key code, such as, for example, time inversion and frequency inversion. A related system for unscrambling scrambled speech transmission is set forth as another embodiment of the invention.

BRIEF DESCRIPTION OF THE DRAWINGS

Other objects, advantages, and features of the invention will become more apparent from the following description, when read in conjunction with the accompanying drawing, in which.

DESCRIPTION OF A PREFERRED EMBODIMENT

Figure 1:
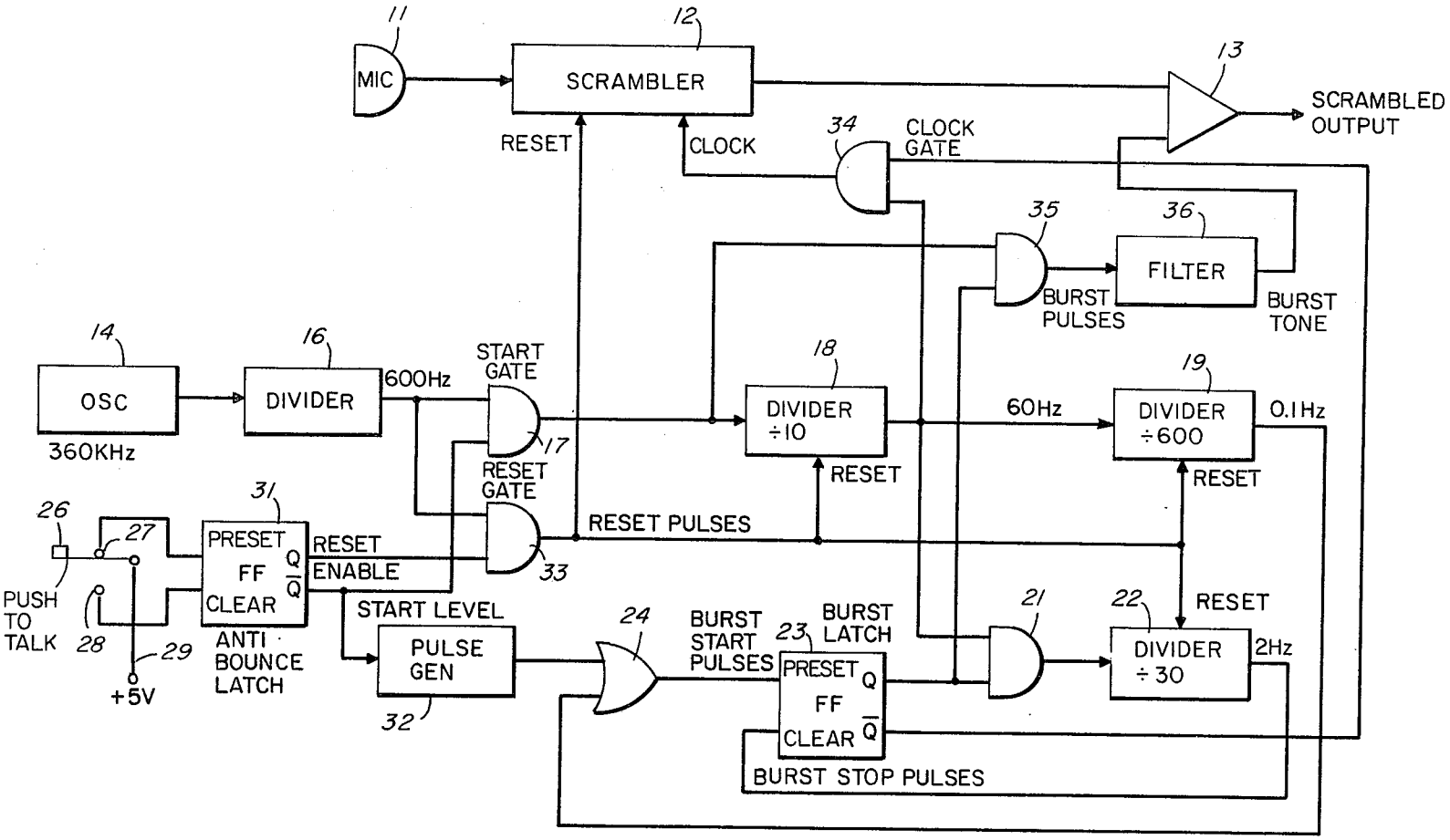
FIG. 1 is a block diagram of a scrambling system in accordance with the invention.

Referring to FIG. 1, there is shown a block diagram of a key-encoder speech scrambler system.

A microphone 11 is adapted to receive the speech sounds and convert the speech into electrical signals, the output of the microphone being coupled to the input of a scrambler 12. The output of the scrambler is coupled to one input of an analog adder circuit 13.

Figure 2:
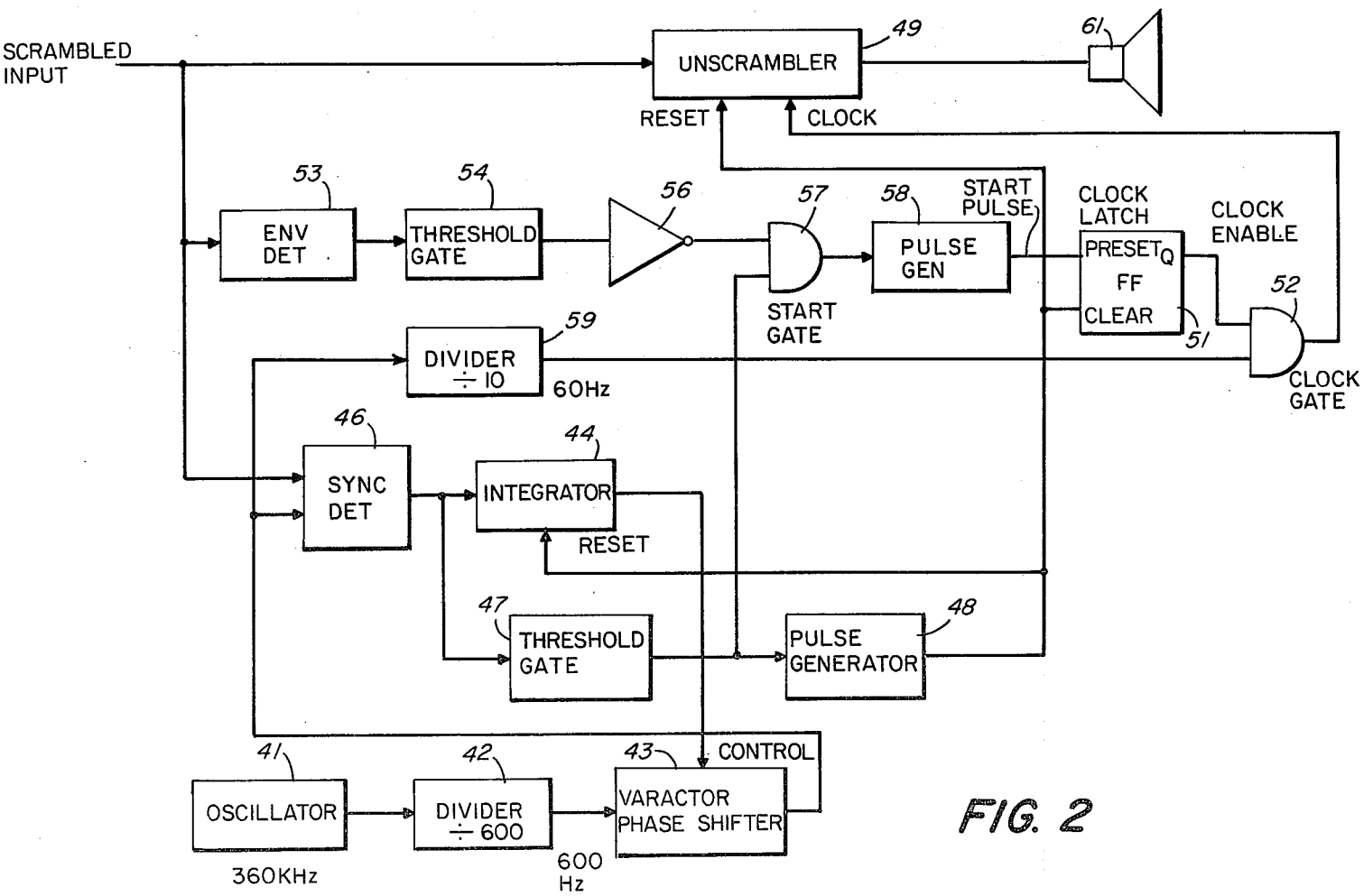
FIG. 2 is a block diagram of an unscrambling system in accordance with the invention.

An oscillator 14, such as a quartz crystal oscillator, is adapted to generate a fixed frequency, such as, for example 360 kHz. All timing for the scrambler system of FIG. 2 is derived therefrom.

The output of the oscillator 14 is coupled to a frequency divider circuit 16, which, for example, can divide the 360 kHz signal from the oscillator 14 by 600 so as to provide a 600 Hz signal, either as pulses or sine waves.

The output of the divider 16 is coupled through an AND gate 17 to the input of a frequency divider 18. The divider 18, in an example, can divide the signal applied there to by 10, to produce the basic clock frequency, assumed in this example to be 60 Hz.

The output of the frequency divider 18 is coupled to the input of another frequency divider 19. The divider 19, for example, can divide the signal applied thereto by 600 to produce 0.1 Hz pulses.

The output from the divider 18 is also coupled to an AND gate 21 whose output is coupled to a divider 22. The divider 22 divides the 60 Hz signal applied thereto by 30 (in one example) to determine the length of the burst (0.5 second in this case).

A bistable multivibrator 23, shown as a set-reset flip-flop has its preset input terminal coupled to the output of an OR gate 24. Its clear input terminal is coupled to the output of the divider 22. When a pulse is provided to the preset terminal of the flip-flop 23, the flip-flop 23 provides an enabling output level into its Q output terminal. Contrariwise, when a pulse is provided to the clear terminal, an enabling level is provided onto the $\overline{Q}$ output terminal.

A "push-to-talk" button 26 has a lead which normally engages a contact 27; when depressed, the button 26 causes the lead to engage with a contact 28. The button lead is coupled to a point of reference potential 29, such as +5 volts (logic level 1).

The contact 27 is coupled to a preset input terminal of a set-reset flip-flop 31 whose clear input terminal is coupled to the contact 28. The $\overline{Q}$ output terminal of the flip-flop 31 is coupled to a second input of the AND gate 17, and also to a pulse generator 32 which provides pulses to the OR gate 24.

The output of the divider 16 is coupled to one input of a two-input AND gate 33, the second input being coupled to receive the Q output of the flip-flop 31.

The output of the AND gate 33 is coupled to the reset terminal of the scrambler 12 and is coupled to the reset terminals of the dividers 18, 19 and 22.

The $\overline{Q}$ output of the flip-flop 23 is coupled to one input of a two-input AND gate 34, the second input being coupled to receive the output from the divider 18. The output of the AND gate 34 is coupled to the clock input of the scrambler 12.

The output from the AND gate 17 and the Q output from the flip-flop 23 are coupled as two inputs to an AND gate 35, the output of which is coupled through a 600 Hz filter 36 to a second input of the analog adder circuit 13.

The output of the divider 19 is coupled as a second input to the OR gate 24.

The analog adder circuit 13 provides a scrambled output. In operation, the scrambler system of FIG. 1 takes segments of speech from the microphone 11 in a time sequence determined by an internal key code (also, it can scramble the individual segments by an inversion process in accordance with a second internal key code). Synchronization of the scrambler 12 requires two inputs: (a) a reset input pulse which resets a sequencer (not shown) in the scrambler 12 to the start of the key code, and (b) a clock pulse which determines the start of each segment.

All timing is derived from the quartz crystal oscillator 14 (e.g., 360 KHz). Such an oscillator 14 is commonly available for use in electronic watches with an accuracy of 15 seconds per month, or less than a millisecond per minute. The frequency is divided by 600 to provide a 600 Hz signal (pulses or sine waves). The 600 Hz signal is divided by ten to produce the basic clock frequency, assumed in this example to be 60 Hz. The 60 Hz is then divided by 600 to produce 0.1 Hz pulses which determine the frequency of synchronization burst tones (assumed here to be one burst every ten seconds).

The 60 Hz signal is also passed through the AND gate 21 to the divide by 30 counter 22, which determines the length of the burst (0.5 second in this case). The AND gate 21 is opened and closed by means of the flip-flop 23 turned on with burst start pulses from the gate 24 and turned off with burst stop pulses derived from the output of the divide-by-30 counter 22.

The sender presses the push-to-talk button 26 which actuates the flip-flop 31 which acts as an anti-bounce latch. The latch prevents the generation of multiple start signals from vibratory multiple closings of the pushbutton 26. Releasing of the button 26 stops the transmission, switching the anti-bounce latch 31 in the opposite direction. With the button 26 released, 600 Hz reset pulses are fed through the AND gate 33 (reset gate) under the control of a reset enable signal from the anti-bounce latch flip-flop 31. These pulses reset the scrambler 12 and three of the divider circuits 18, 19, 22 so that when the button 26 is pressed to talk, the first clock pulses (a) determine the 10-second interval between bursts, (b) measure the length of an initial burst, and (c) determine that the first 600 Hz pulse is coincident with the first 600 Hz pulse.

The 600 Hz signal is applied to a start gate 17 and gated therethrough by the start level signal from the anti-bounce latch 31. The start level signal is generated when the push-to-talk button 26 is depressed. At the same time, the start level signal triggers the pulse generator 32, which produces a burst start pulse, fed to the preset input of the burst latch flip-flop 23 through the OR gate 24. The burst start pulse, fed to the preset input of the burst latch flip-flop 23, sets the flip-flop 23. Setting the flip-flop 23 does three things: (a) it inhibits the clock gate (AND gate) 34, blocking clock pulses from the scrambler 12 for the duration of the burst, (b) it enables the burst gate (AND gate) 21, starting the divide-by-30 counter 22, and (c) it enables the burst gate (AND gate) 36, which feeds 600 Hz pulses to the 600 Hz filter 36, the output of which is transmitted to the output through an analog adder circuit 13. After 30 pulses of the 60 Hz signal are counted by the divide-by-30 counter 22, a burst stop pulse from the counter 22 turns off the burst latch flip-flop 23. Thus, one-half second of a 600 Hz burst tone appears at the output when the push-to-talk button 26 is depressed, and this burst is subsequently regenerated every ten seconds until the button 26 is released. At the beginning of each burst, the scrambler 12 is reset, and no clock pulses are received by the scrambler 12 until the end of the burst. The first clock pulse after the end of the burst then starts the scrambling cycle in motion at the beginning of the key code. Subsequently, scrambled pulses appear at the output of the scrambler 12. Thus, the burst signal and the scrambled signal are separated in time: when the burst is on, the scrambled signal is not, and vice versa.

Referring to FIG. 2, there is depicted a block diagram of an unscrambler system in accordance with one embodiment of this invention.

A 360 kHz quartz crystal oscillator 41 is coupled through a divider 42 which divides the signal applied thereto by 600. The resultant 600 Hz signal is coupled to a varactor phase shifter 43 which is controlled by the output of an integrator 44. A synchronous detector 46 has, as its inputs, the scrambled input signal and the output of the varactor phase shifter 43. The output of the synchronous detector 46 is coupled to the integrator 44.

The output of the synchronous detector 46 is also coupled to a threshold gate 47 which provides an enabling output when the input thereto exceeds a predetermined level. The output of the threshold gate 47 is coupled to trigger a pulse generator 48, the output of which is coupled to reset the integrator 44.

The output of the pulse generator 48 is coupled to the reset terminal of an unscrambler 49. Also, the output of the pulse generator 48 is coupled to the clear input of a flip flop 51, herein referred to as a clock latch. The Q output of the flip-flop 51 is coupled through an AND gate 52 (clock gate) to the clock input of the unscrambler 49.

The scrambled input, in addition to being coupled to the synchronous detector 46, is coupled to the input of the unscrambler 49 and to the input of an envelope detector 53. The output of the detector 53 is coupled through a threshold gate 54, an inverter 56, to an AND gate 57 (start gate). The output of the start gate 57 is coupled to a pulse generator 58 which provides pulses to the preset input of the clock latch flip-flop 51.

The output of the threshold gate 47 is coupled to the other input of the start gate 57. The output of the varactor phase shifter 43, in addition to being coupled to the synchronous detector 46, is coupled to a divider 59 which transforms the 600 Hz signal applied thereto to a 60 Hz signal. The 60 Hz signal is applied to the other input of the clock gate (AND gate) 52.

The unscrambler 49 drives a loudspeaker 61. The unscrambler system of FIG. 2 contains some similar elements to the scrambler system of FIG. 1. The unscrambler 49 operates in the manner of the scrambler 12, except that for time sequence scrambling it uses a different key code (an unscrambling code associated with the scrambling code in use). The 360 KHz quartz crystal clock 41 in the unscrambler system provides the correct frequency but requires subsequent phase synchronization of the 600 Hz signal from the divide-by-600 counter 42. The phase is controlled by means of the varactor phase shifter 43, the phase shift being a function of the control signal, obtained from the synchronous detector 46 and integrator 44. The inputs of the synchronous detector 46 are the scrambled input signal and the output of the varactor phase shifter 43. An output is obtained from the synchronous detector 46 when a 600 Hz signal (the burst) is received. Some integration and/or filtering within the synchronous detector 46 prevents response to ordinary speech signals. Within a few cycles of the 600 Hz burst signal, the output of the synchronous detector 46 passes a predetermined threshold of the threshold gate 47, and the voltage at the output of the gate 47 rises abruptly, triggering the pulse generator 48. The pulse from this generator 48 resets the level of the integrator 44, which integrates the synchronous detector 46 output. The integrated output is then applied as a control signal to the varactor phase shifter 43. As the voltage changes, the varactor 43 produces a shift in the phase of the 600 Hz signal from the crystal oscillator 41. The phase continues to change until a point of stable equilibrium is reached in which further increase in the control voltage applied the varactor phase shifter 43 starts to produce a decrease in the output level of the integrator 44. The phase shifter 43 is capable of at least 360 degrees of phase control to insure that an equilibrium point is found for all phases of the incoming burst.

The circuit of FIG. 2 is designed to achieve synchronization well within the time duration of the burst. When the burst is over, the integrator 44 output is constant, since there is no further contribution from the synchronous detector 46. The inherent stability of the oscillators 14, 41 in the scrambler and unscrambler systems of FIGS. 1 and 2 then assures that synchronism is maintained for the 10-second interval between bursts (or longer time, if the system is designed for longer intervals).

The clock signal to the unscrambler 49 is controlled by the burst signal to correspond to the clocking cycle of the scrambler 12. The flip-flop 51 serves as the clock latch to inhibit the clock pulses of the unscrambler during the burst. The clock latch 51 (through its clear input terminal) and the unscrambler 49 are both reset by the same reset pulse used at the beginning of the burst to reset the integrator 44. The clock pulses are applied to the unscrambler 49 at the moment that the burst stops. That moment is determined by comparison of the outputs of the synchronous detector 46 and the envelope detector 53 by means of the threshold gates 47, 54, the inverter 56, and the AND gate (start gate) 57. The output of the start gate 57 is at the high (logic 1) level only when the synchronous detector 46 output is above threshold and the output of the envelope detector 53 is below threshold. This situation occurs only at the end of the burst, when the slow fall time of the synchronous detector 46 prevents its output from following the rapid decline of the envelope detector 53 output. Between bursts, the synchronous detector 46 output is below threshold, thereby inhibiting an output from the start gate 57, even though that gate 57 receives an input from the envelope detector 53. At the end of the burst, the output obtained from the start gate 57 is applied to the pulse generator 58, which produces a start pulse that operates the clock latch flip-flop 51. The clock latch 51, in turn, generates a clock enable signal which allows passage of the clock pulses through the clock gate 52 to the unscrambler 49.

In operation, the sender presses the press-to-talk button 26, pauses during the burst (which can be fed to his speaker 61), then commences to talk. As he speaks, his voice signal is stored in the scrambler 12. After a number of segment durations equal to the length of the sequence key code, signals start to be read out of the scrambler 12 in the sequence determined by the code. They continue to be read out until either the next burst occurs or the pushbutton 26 is released. As an optional feature, the scrambler system can include a time delay of the reset signal so that reset occurs slightly after the button 26 is released, thereby insuring that the speech segments stored just before the button 26 is released are processed and transmitted. Without such a delay, the sender might inadvertently cut off the end of his message.

A signal is transmitted from sender to receiver which consists of (a) a burst, (b) a pause, and (c) scrambled speech segments. If the button 26 is held down, this process is repeated cyclically, every ten seconds. The code can typically have thirty elements, applied cyclically. In that case, the pause is of one-half second duration.

When the scrambled signals reach the receiver, the unscrambler 49 is being clocked. The burst signal turns off and resets the unscrambler clock. At the end of the burst, the clock is restarted, and the incoming scrambled signal starts to be processed. The first portion of that signal is the pause invoked by the scrambler 12, which is then followed by the scrambled signal. That signal is then stored in accordance with the unscramble sequence key. After one cycle of the key code, the unscrambled signal starts to appear. Thus, it is delayed from the original speech by twice the duration of the sequence code (in addition, of course, to any propagation delays that might be incurred in the transmission system). The unscrambled signal is interrupted every ten seconds by a burst signal (which can also optionally be fed to the receiver speaker). If the speaker talks through the burst, the unscrambled output is interrupted only for the duration of the burst, and the only part of the voice signal that is lost is the part spoken during the burst. When the clock resumes operation after the burst, it reads out the segments that had been stored just before the burst.

In the above examples, the time durations and frequencies chosen are illustrative. Different values are also practical. It is feasible for some applications to use only one burst at the beginning of a communication and not interrupt the communication with additional bursts.

The foregoing describes a one-way (simplex) system with only one scrambler 12 and one unscrambler 49. It is obvious that other variations will become apparent to those skilled in the art, for example, the elements can be arranged for two-way (duplex) communication. Switches can be used to change the mode of each station from transmit to receive, and vice versa. The same device can be used as a scrambler 12 and as an unscrambler 49, the only difference being the code (and then only if a sequence code is used). The switches can be voice actuated so that when one person starts to talk his system is automatically switched to the transmit mode from the normal receive mode.

This invention sets forth a means for scrambled speech transmission over a narrow band channel with the use of a key code. The secrecy of transmission is achieved with a secret key rather than with secret apparatus. Thus, the apparatus can be widely used by different users with different keys, and each user can have his communication secure against decoding by any of the other users, unless they share his secret key. The invention can be implemented with solid-state devices and circuits capable of being produced as integrated circuits or hybrid integrated/printed circuits. Thus, it is possible to produce the devices at a low cost in high volume production, providing for large-scale use of such devices in government and business applications.

IN GENERAL

Various modifications will suggest themselves to those skilled in the art without departing from the spirit and scope of this invention. Thus, the system can use a variety of combinations of inversion and/or sequence scrambling: for example, Taking segments in consecutive order but inverting selected segments in accordance with a mode key.

Taking segments in consecutive order, frequency inverting some segments, time inverting other segments, and leaving the remaining segments in their original (non-inverted) form.

Taking segments in consecutive order, frequency inverting some segments and time inverting all of the other segments.

Doing any of the above with the segments scrambled in their sequence.

Time inversion scrambling and sequence scrambling require storage of segments of the speech signal. The storage can be accomplished with solid state semiconductor memories in either digital or analog form; e.g., with shift register or random-access memories (RAM) in MOS or bipolar form or with charge-coupled device (CCD) or charge-injection device (CID) memories. Alternatively, the storage can be accomplished magnetically with tape, disc, or bubble memories. Other type memories, of course, may be feasible, such as vacuum tubes or magnetic cores.

What is claimed is:

1. A system for scrambling speech transmission in a coded manner comprising a microphone for converting speech in its audio form to an electrical form;

scrambling means coupled to said microphone for coding individual segments of speech in accordance with an internal key code, said scrambling means being adapted to be synchronized by a reset pulse for resetting the order of coding within said scrambling means and by a clock pulse which determines the start of each segment;

a "talk" switch having an "on" and an "off" position;

oscillating means adapted to provide a signals at a burst frequency;

first frequency dividing means for converting said burst frequency to a clock frequency;

first two-input AND gate means having one input coupled to receive said oscillating means, having a second input adapted to receive an enabling level when said "talk" switch is in said "on" position, and having an output coupled to an input of said first frequency dividing means;

second frequency dividing means having an input coupled to an output of said first frequency dividing means for determining the frequency of synchronization burst tones;

second two-input AND gate means having one input coupled to the output of said first frequency dividing means;

a first dividing counter means having an input coupled to an output of said second AND gate means;

a first flip-flop means having a set input terminal, a reset input terminal, a set output terminal and a reset output terminal, said set output terminal being coupled to a second input of said second two-input AND gate means, said reset input terminal being coupled to an output of said first dividing counter means, and said reset output terminal being coupled so as to enable signals at said clock frequency to synchronize said scrambling means when an enabling level is on said reset output terminal;

a pulse generator adapted to provide a pulse when said "talk" switch is placed into an "on" position, said pulse being coupled to the set input terminal of said first flip-flop means;

means responsive to said "talk" switch being in said "off" position for resetting said scrambling means, said first frequency dividing means, said second frequency dividing means, and said first dividing counter means;

third two-input AND gate means having one input coupled to said output of said first AND gate, and having a second input coupled to said set output terminal of said first flip-flop means; and an output terminal coupled to an output of said scrambling means, and coupled to an output of said third AND gate.

2. The system as recited in claim 1 wherein said coding is performed by time sequencing individual segments of speech, and said reset pulse resets the order of time sequencing within said scrambling means.

3. The system as recited in claim 2 wherein said output of said second frequency dividing means is coupled to said set terminal of said first flip-flop means.

4. The system as recited in claim 3 wherein said scrambling means, in addition to time sequencing individual segments of speech determined by an internal key code, also scrambles the individual segments by an inversion process in accordance with a second internal key code.

5. The system as recited in claim 4 wherein said inversion process is a time inversion process.

6. The system as recited in claim 4 wherein said inversion process is a frequency inversion process.

7. The system as recited in claim 2 wherein said output of said second frequency dividing means is coupled to said set terminal of said first flip-flop means.

8. The system as recited in claim 7 wherein said inversion process is a time inversion process.

9. The system as recited in claim 7 wherein said inversion process is a frequency inversion process.

10. A system for unscrambling scrambled speech transmission in a predetermined coded manner comprising unscrambling means coupled to receive a scrambled input signal in accordance with a predetermined scrambling code for time sequencing individual segments of speech in accordance with an internal key code, said unscrambling means being adapted to unscramble in accordance with an unscrambling code which is associated with the scrambling code in use, said unscrambling means being adapted to be synchronized by a reset pulse for resetting the order of time sequencing within said unscrambling means and by a clock pulse which determines the start of each segment;

oscillating means adapted to provide signals, at a burst frequency;

phase shifting means having an input coupled to receive an output from said oscillating means, having an output, and having a control terminal;

a synchronous detector having one input coupled to said output of said phase shifting means, having a second input coupled to receive said scrambled input signal, and having an output, said detector output providing a signal when a burst signal is detected at said second input;

an integrator having an input coupled to said detector output, having a reset terminal, and having an output coupled to control said phase shifter;

a threshold gate having a predetermined threshold, coupled to receive the output of said detector and provide an output level therefrom when said detector output exceeds said predetermined threshold;

a pulse generator adapted to be triggered by said output level of said threshold gate; a pulse output from said generator being coupled to reset said integrator;

means responsive to an end of a burst signal detected from said scrambled input for providing a "start" pulse;

a first flip-flop having a set input terminal coupled to receive said "start" pulse, having a reset input terminal coupled to receive said pulse output from said pulse generator, and having a set output terminal;

means coupled to said output of said phase shifting means for providing a clock signal;

a first two-input AND gate having one input coupled to receive said clock signal, having a second input coupled to said set output terminal, and having an output coupled to clock said unscrambling means; and means coupling the output of said pulse generator to reset said unscrambling means.

11. The system as recited in claim 10 wherein said unscrambling means, in addition to time sequencing individual segments of speech determined by an internal unscrambling code, also unscrambles the individual segments by an inversion process in accordance with a second internal key code.

* * * * *